US005692396A

United States Patent [19]

Rathbone

[11] Patent Number: 5,692,396

[45] Date of Patent: Dec. 2, 1997

[54] AIR SEPARATION

[75] Inventor: Thomas Rathbone, Farnham, England

[73] Assignee: The BOC Group plc, Windlesham Surrey, England

[21] Appl. No.: 733,826

[22] Filed: Oct. 18, 1996

[30] Foreign Application Priority Data

Oct. 27, 1995 [GB] United Kingdom ..... 9521996

[51] Int. Cl.[6] ..... F25J 3/00

[52] U.S. Cl. ..... 62/646; 62/654; 62/913

[58] Field of Search ..... 62/646, 654, 913

[56] References Cited

U.S. PATENT DOCUMENTS

| | | | |
|---|---|---|---|
| 5,084,081 | 1/1992 | Rohde | 62/913 |
| 5,400,600 | 3/1995 | Grenier | 62/646 |
| 5,408,831 | 4/1995 | Guillard et al. | 62/646 |

*Primary Examiner*—Ronald C. Capossela

*Attorney, Agent, or Firm*—David M. Rosenblum; Salvatore P. Pace

[57] ABSTRACT

Compressed, purified, vaporous air and liquid air streams are introduced into a higher pressure rectification column. A stream of oxygen-enriched liquid flows from an outlet of the higher pressure rectification column via a reboiler and an expansion valve into a vessel. The oxygen-enriched liquid is partially vaporised in a boiler located in the vessel. The residual liquid flows from the vessel and a condenser to a lower pressure rectification column in which oxygen and nitrogen products are separated. A stream of vapour flows from the boiler through an outlet from the vessel to a pipeline which leads the air back for compression with incoming air. A greater yield of oxygen, and, if separated, argon is made possible by this recycle.

18 Claims, 2 Drawing Sheets

AIR SEPARATION

BACKGROUND OF THE INVENTION

This invention relates to a method and apparatus for separating air.

The most important method commercially for separating air is by rectification. Typically, there are performed steps of compressing a flow of air and introducing a part of the compressed air flow in vapour state into a higher pressure rectification column, separating the vaporous air in the higher pressure rectification column into a nitrogen fraction and an oxygen-enriched liquid fraction, withdrawing a stream of the oxygen-enriched liquid fraction from the higher pressure rectification column, passing a first part of the oxygen-enriched liquid stream along a route that leads to a lower pressure rectification column, and separating an oxygen product in the lower pressure rectification column. Reflux for both columns is typically formed by condensing nitrogen separated in the higher pressure rectification column. If desired, a liquid nitrogen product may also be taken from the condensate. If the process is required to produce one or both of a liquid oxygen and a liquid nitrogen product, a part of the air is introduced into one or both of the rectification columns in liquid state.

The incoming compressed air is generally purified by adsorption therefrom of impurities of relatively low volatility, particularly water vapour and carbon dioxide. Hydrocarbons may also be removed from the incoming air by adsorption. The thus purified air is typically cooled to a temperature at or near to its saturation temperature by indirect heat exchange with return streams.

If it is desired to separate an argon product, a stream of oxygen vapour enriched in argon (typically containing from 6 to 12% by volume of argon) and is separated in a further rectification column to produce an impure or pure argon product.

In order to maintain an energy balance within the arrangement of columns, it is generally necessary to employ a net flow rate of liquid into the columns equal to the net flow rate at which liquid products are withdrawn therefrom. Thus, as a greater proportion of a product of the air separation is taken in liquid state from the columns, so a greater proportion of the air needs to be introduced into the arrangement of columns in liquid state. In practice, the majority of such liquid air is typically introduced into the higher pressure rectification column. The result is that the proportion of air entering the higher pressure rectification column in vapour state is reduced. Less nitrogen is therefore separated from the air in the higher pressure rectification column. For each unit of liquid nitrogen taken as product, the nitrogen separated in the higher pressure rectification column is reduced by about 0.4 units. The reflux to the lower pressure rectification column is therefore reduced by about 1.4 units (the 1 unit of extra liquid nitrogen product and the 0.4 units reduction in the nitrogen separated in the higher pressure rectification column).

The reduction in reflux in the lower pressure rectification column causes there to be a reduction in the yield or recovery of oxygen. If an argon product is separated, there is also a reduction in the yield or recovery of argon. The reduction in the argon recovery tends to become more marked than that in the oxygen recovery as, for example, liquid nitrogen production is increased. In practice, there is therefore a ceiling placed on the proportion of the products of the air separation and particularly, for example, the proportion of liquid nitrogen that can be obtained from the rectification columns in liquid state while still obtaining satisfactory yields of oxygen and/or argon. It has been proposed to ameliorate this problem in EP-A-0 580 348 by recycling a nitrogen stream from the lower pressure rectification column, warming the nitrogen to ambient temperature, recompressing the nitrogen, recooling the compressed nitrogen, and condensing it. Such a nitrogen recycle may be performed in addition to an air recycle.

Disadvantages of the nitrogen recycle are that it requires an additional compressor and that the feed to the additional compressor is provided at only slightly above atmospheric pressure.

It is an aim of the method and apparatus according to the invention to make possible a raising of the ceiling on oxygen yield and, if separated as product, the argon yield without recourse to a nitrogen recycle of the type described above.

SUMMARY OF THE INVENTION

According to the present invention there is provided a method of separating air, wherein a part of the air is introduced into an arrangement of rectification columns in a liquid state and a liquid nitrogen product is taken therefrom, a part of the compressed air flow is introduced in vapour state into a higher pressure rectification column of the arrangment of rectification columns and the air is separated therein into a nitrogen fraction and an oxygen-enriched liquid fraction, withdrawing a stream of the oxygen-enriched liquid fraction from the higher pressure rectification column, passing a first part of the oxygen-enriched liquid stream along a first route that leads to a lower pressure rectification column, and separating an oxygen product in the lower pressure rectification column, and passing a second part of the oxygen-enriched liquid stream along a second route leading back to the compression of the air.

The invention also provides apparatus for separating air, comprising a higher pressure rectification column for separating air into a nitrogen fraction and an oxygen-enriched liquid fraction, and a lower pressure rectification column, an air liquefier, an inlet for liquid air into one or more of the rectification columns, a nitrogen outlet from one of the rectification columns for liquid nitrogen product, at least one compressor for compressing a flow of air, an air inlet to the higher pressure rectification column for air in vapour state, a product outlet from the lower pressure rectification column through an oxygen product, an oxygen enriched liquid outlet from the higher pressure rectification column for a stream of the oxygen-enriched liquid fraction, the oxygen enriched liquid outlet from the higher pressure rectification column communicating with a first route for the oxygen-enriched liquid that leads to the lower pressure rectification column and the oxygen enriched liquid outlet also communicating with a second route for the oxygen-enriched liquid that leads back to the said compressor.

The method and apparatus according to the present invention enable advantages in terms of yield of oxygen and, if produced, argon arising from a recycle to be obtained without requiring additional compression machinery. Further, the recycle stream that flows along the second route is typically taken for recompression at a higher pressure than the corresponding nitrogen stream disclosed in EP-A-580 348. Moreover, since the source of this recycle gas is the oxygen-enriched liquid air, the recycle enhances the rate at which the nitrogen fraction may be formed in the higher pressure rectification column by increasing the ratio of air fed to the higher pressure column in vapour state to that fed in liquid state.

By the term "rectification column" as used herein, is meant a distillation or fractionation column, zone or zones, i.e. a column, zone or zones, wherein liquid and vapour phases are countercurrently contacted to effect separation of a fluid mixture, as for example, by contacting the vapour and liquid phases of packing elements or on a series of vertically spaced trays or plates mounted within the column, zone or zones. A rectification column may comprise a plurality of zones in separate vessels, so as to avoid the use of a single vessel resulting in a rectification column of undue height. For example, it is known to include a height of packing amounting to approximately 200 theoretical plates in an argon rectification column. If all this packing were included in a single vessel, the vessel may typically have a height of 60 meters. It is therefore frequently desirable to construct the argon rectification in two separate vessels so as to avoid having to employ a single, exceptionally tall, vessel.

The method and apparatus according to the present invention readily lends themselves to use in relatively complex air separation plants. Some simplification is made possible in that the first and second routes may have an upstream portion in common.

In a preferred example of the method and apparatus according to the invention, the first and second routes divide from one another in a boiler in which the oxygen-enriched liquid is partially reboiled, resulting vapour following the second route, and residual liquid following the first route. As a result of the partial reboiling the liquid phase becomes enriched in oxygen and the vapour phase depleted of oxygen. As a result, the vapour that is returned to the compression via the second route typically has a composition approximating to that of air. Accordingly, the compression machinery does not need to handle gas that is substantially enriched in oxygen. Indeed, the vapour resulting from the partial reboiling of the oxygen-enriched liquid in the boiler typically contains from 20 to 22% by volume of oxygen.

The partial reboiling of the oxygen-enriched liquid is preferably performed at a pressure at least 1 bar in excess of the pressure at the top of the lower pressure rectification column but at least 1 bar below the pressure at the top of the higher pressure rectification column. At such pressures, the fluid returning via the second route may readily be introduced into a location downstream of a first stage of a main air compressor used to compress the incoming air but upstream of a downstream stage of such main air compressor.

The oxygen-enriched liquid is preferably partially reboiled by indirect heat exchange with a vapour stream withdrawn from the lower pressure rectification column. If an argon product is produced, the stream employed to heat the boiler so as partially to boil the oxygen-enriched liquid may have the same composition as the stream of argon-containing fluid that is taken from the lower pressure rectification column for separation in the further rectification column. As a result of indirect heat exchange with the partially vaporising oxygen-enriched liquid, the stream of vapour withdrawn from the lower pressure rectification column is typically condensed. The resulting condensate may be returned to the lower pressure rectification column, preferably with a return stream from the further fractionation column, if an argon product is produced.

The argon product may be purified by removal of nitrogen therefrom in a fractionation column which has a reboiler associated therewith. In this event, the reboiler associated with the fractionation column preferably lies on the common upstream portion of the first and second routes, whereby the reboiler is heated by the oxygen-enriched liquid and the oxygen-enriched liquid is itself sub-cooled.

As an alternative to heating the boiler in which the oxygen-enriched liquid is partially reboiled with a stream taken from the lower pressure rectification column, a stream of nitrogen vapour may be taken from the higher pressure rectification column and used for this purpose. This alternative makes it possible to perform the partial reboiling at a higher pressure than is possible when the stream comprises an oxygen-argon mixture taken from the lower pressure rectification column but may lead to a shortage of reboil in the section of the lower pressure column between its reboiler and its outlet for the argon-oxygen mixture.

If an argon product is produced, the first route may typically include a condenser associated with the further rectification column in which argon is separated. The residual oxygen-enriched liquid is preferably partially boiled in the condenser and not only is the remaining liquid sent to the lower pressure rectification column, but so also is the resulting vapour.

Another alternative for carrying out the reboiling of the oxygen-enriched liquid is to employ a condenser associated with the further rectification column for this purpose. This alternative suffers from the disadvantage that, in general, the partial reboiling needs to be performed at a relatively low pressure, thus increasing the amount of work that needs to be performed when recompressing the fluid recycled via the second route.

The compressed air is typically purified by conventional means. For example, it can be purified by adsorption to remove water vapour, carbon dioxide, and, sometimes, hydrocarbon impurities. Refrigeration necessary for the operation of the method and apparatus according to the present invention may be provided by conventional means, for example by the expansion in at least one turbine with the performance of external work of a stream of the purified compressed air. In a preferred arrangement, the air is compressed in a main air compressor, and at least part of the flow of vaporous air into the higher pressure rectification column comprises air that has been further compressed and expanded with the performance of external work. Further, the liquid air preferably comprises a stream of further compressed air which is maintained at pressure and which is cooled in heat exchange with returning product streams. If the demand for liquid nitrogen is relatively large, some of the work expanded air is preferably recycled for further compression.

Liquid nitrogen reflux for the lower pressure rectification column may be taken directly from condensate formed by condensing nitrogen vapour separated in the higher pressure rectification column, or indirectly by withdrawing a liquid stream from a level a few theoretical plates below the top of the higher pressure rectification column. The liquid nitrogen product may be sent to storage. If desired, a part of the liquid nitrogen product, or even, on occasions, all of it, may be converted to elevated pressure gas by pumping it to a desired pressure and vaporising it in heat exchange with air being cooled.

The oxygen product may be taken in gaseous and/or liquid state. An elevated pressure gaseous oxygen product may be formed by pressurising a stream of liquid oxygen product, and vaporising the pressurised liquid oxygen in indirect heat exchange with air being cooled.

BRIEF DESCRIPTION OF THE DRAWINGS

The method and apparatus according to the present invention will now be described by way of example with reference to the accompanying drawings, in which.

The drawings are not to scale.

DETAILED DESCRIPTION

Figure 1:
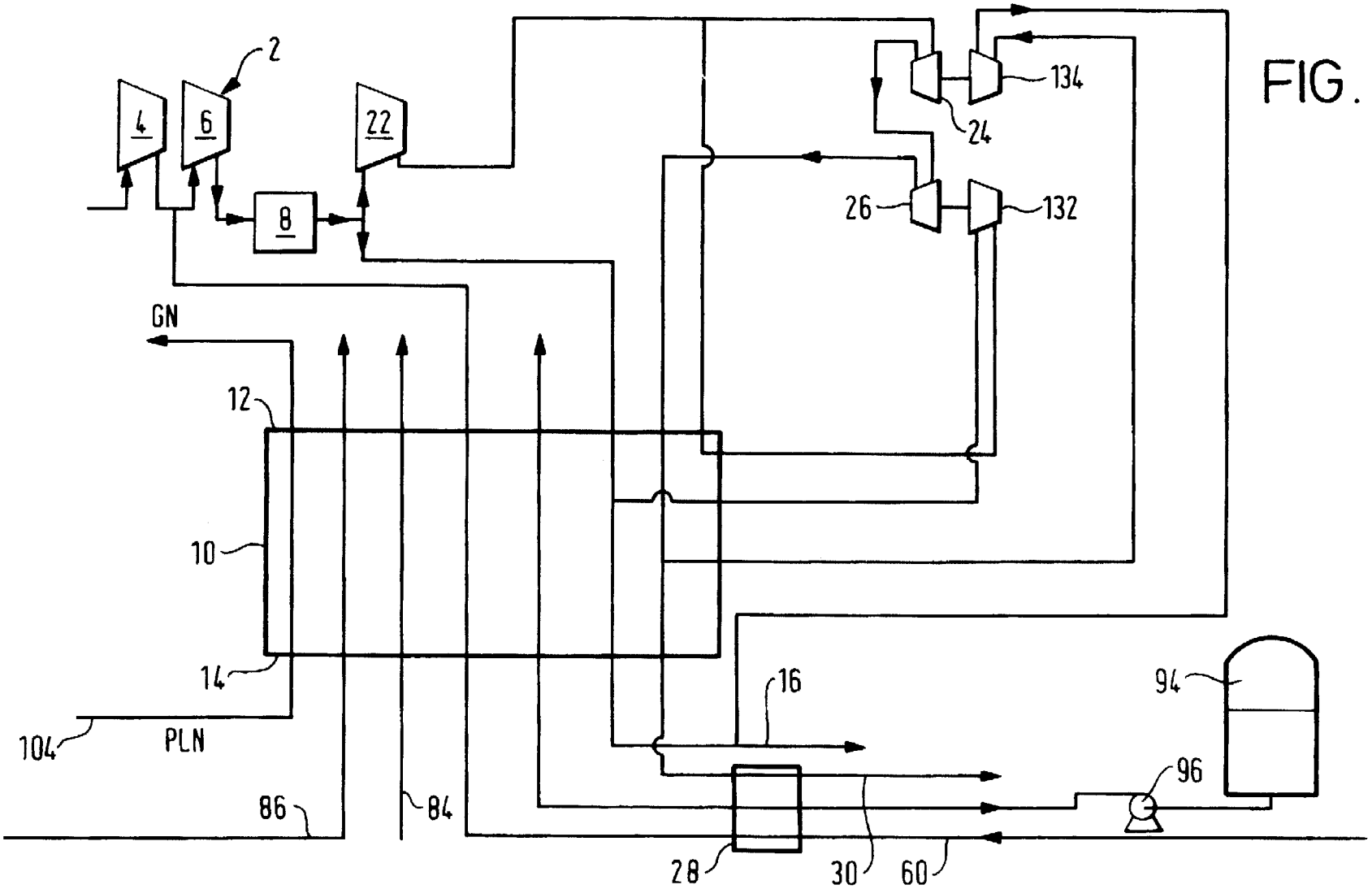
FIG. 1 is a schematic flow diagram of part of an air separation plant.

Referring to FIG. 1 of the drawings, a stream of filtered air flows into the upstream stage 4 of a main air compressor 2 which additionally includes a downstream stage 6. Heat of compression is removed from the air between the stages 4 and 6 and downstream of the stage 6. A compressed air stream at approximately ambient temperature is thereby produced. The compressed air stream is purified in a purification unit 8. The purification unit 8 comprises beds of adsorbent effective to remove water vapour, carbon dioxide and other impurities (for example, hydrocarbons) from the incoming compressed air. The construction and operation of such purification units are well known in the art and need not be described further herein.

The compressed, pitied air is divided downstream of the purification unit 8 into two streams. One stream flows through a main heat exchanger 10 from its warm end 12 to its cold end 14 and is thereby cooled to approximately its saturation temperature. Resulting vaporous air flows from the cold end 14 of the heat exchanger 10 via a conduit 16 into a bottom region of a higher pressure rectification column 18 (see now FIG. 2) through an inlet 20. A liquid air feed for the higher pressure rectification column 18 is formed by taking that part of the purified compressed air stream that does not flow directly into the main heat exchanger 10 and further compressing it in a booster-compressor 22 (see again FIG. 1). The further compressed air has its heat of compression removed therefrom by an aftercooler (not shown). Downstream of its aftercooling, the further compressed air stream is in turn divided into two subsidiary streams. Once of the subsidiary streams flows through a further booster-compressor 24 and is compressed yet again. The yet further compressed first subsidiary air stream has its heat of compression removed in an aftercooler (not shown) downstream of the booster-compressor 24. The thus cooled yet further compressed stream is sent to a final booster-compressor 26 in which it is raised to an even higher pressure. The resulting first subsidiary air stream, now at the highest pressure that obtains in the plant flows out of the final booster-compressor 26 and has its heat of compression removed therefrom in another aftercooler (not shown). This stream, typically at a pressure above the critical pressure of air, flows through the main heat exchanger 10 from its warm end 12 to its cold end 14 and is thus cooled to below the critical temperature of air. The thus cooled supercritical pressure air stream flows out of the main heat exchanger 10 from its cold end 14 and is sub-cooled in a further heat exchanger 28. The sub-cooled supercritical pressure air stream flows from the heat exchanger 28 to a conduit 30 which has disposed therealong a throttling valve 32 (see again FIG. 2). As the supercritical air stream flows through the throttling valve 32 so its pressure drops to below the critical pressure of air and passes out of the valve 32 in essentially liquid state at approximately the pressure at the bottom of the higher pressure rectification column 18. The liquid air is introduced into the rectification column 18 through an inlet 34 at a level above that of the inlet 20.

The air is separated in the higher pressure rectification column 18 into a nitrogen fraction and an oxygen-enriched liquid fraction. The column 18 contains liquid-vapour contact devices 36 in the form of packing or trays so as to effect intimate contact between rising vapour and descending liquid. Mass transfer takes place between the two phases as a result of intimate contact and the vapour becomes richer in nitrogen as it ascends, and the liquid richer in oxygen as it descends the column 18. The higher pressure rectification column 18 has a condenser-reboiler 38 associated with its top. Nitrogen vapour passes out of the top of the column 18 and is condensed in the condensing passages of the condenser-reboiler 38. Part of the resulting condensate is returned to the top of the column 18 as reflux. The remainder is withdrawn via a conduit 40, is sub-cooled by passage through a part of a further heat exchanger 42, is passed through a throttling valve 44, and flows to storage in tank 45 as a liquid nitrogen product.

An oxygen-enriched liquid fraction is obtained at the bottom of the higher pressure rectification column 18. The fraction typically contains from about 30 to 35% by volume of oxygen. A stream of the oxygen-enriched liquid is withdrawn from the bottom of the higher pressure rectification column 18 through an outlet 46, is sub-cooled first by passage through a part of the heat exchanger 42, and downstream thereof, by passage through a reboiler 48 whose operation shall be described below. The resulting sub-cooled oxygen-enriched liquid flows from the reboiler 48 through a throttling valve 50 into a vessel 52 which houses a boiler 54 of the thermo-siphon kind. The boiling passages of the boiler 54 operate at a pressure at least 1 bar less than the pressure at the top of the higher pressure rectification column 18 and at least 1 bar greater than the pressure at the top of the lower pressure rectification column 56. The reboiler 54 partially boils the oxygen-enriched liquid introduced or flashed into the vessel 52 through the valve 50. A vapour approximately of the same composition as air and a liquid further enriched in oxygen (typically containing about 47% by volume of oxygen) are thereby formed. The vapour flows out of the top of the vessel 52 through an outlet 58 into a conduit 60 which, referring now to FIG. 1, terminates in the heat exchanger 28. The vapour stream flows through the heat exchanger 28 countercurrently to the supercritical air stream and is warmed in indirect heat exchange with the supercritical air stream. The thus warmed vapour flows through the main heat exchanger 10 from its cold end 14 to its warm end 12 and is thereby warmed to approximately ambient temperature. This stream is mixed with the air stream at a region downstream of the main compressor stage 4 but upstream of the main compressor stage 6. The second route referred to above thus comprises the outlet 46, the heat exchanger 42, the reboiler 48, the throttling valve 50, the vessel 52, the boiler 54, the outlet 58 from the vessel 52, the conduit 60, the heat exchanger 28, and the main heat exchanger 10 from its cold end 14 to its warm end 12.

The residual liquid, further enriched in oxygen, flows from the vessel 52 through an outlet 61 at the bottom thereof, through a throttling valve 62 and into a condenser 64. The oxygen enriched liquid is partially vaporised in the condenser 64. (The main function of the condenser 64 shall be described below.) Remaining liquid flows from the condenser 64 into the lower pressure rectification column via an inlet 66. Vapour formed in the condenser 64 flows into the lower pressure rectification column 56 through an inlet 68. Thus, the first route referred to above comprises the outlet 46 from the higher pressure rectification column 18, the heat exchanger 42, the reboiler 48, the valve 50, the vessel 52, the boiler 54, the outlet 60 from the vessel 52, the valve 62, the condenser 64, and the inlet 66 to the lower pressure rectification column 56. In addition, the conduit leading from the top of the condenser 64 to the inlet 68 of the lower pressure rectification column 56 can be viewed as an additional part of the first route.

In addition to the air streams introduced into the lower pressure rectification column 56 through the inlets 66 and 68, a liquid stream is withdrawn from the higher pressure rectification column 18 at the same level as that at which the inlet 34 is located and is introduced into the lower pressure rectification column 56 through an inlet 70 at a level above that of the inlets 66 and 68.

An impure liquid nitrogen stream containing about 0.1% by volume of oxygen is withdrawn from the higher pressure rectification column 18 at a level a few theoretical plates below the top of the column 18 through an outlet 72 flows through a part of the heat exchanger 42 and is thereby sub-cooled, and is flashed through a throttling valve 74 into a phase separator 76. The resulting liquid flows from the phase separator 76 into the top of the lower pressure rectification column 56 through an inlet 78. This liquid nitrogen serves as reflux for the lower pressure rectification column 56.

An upward flow of vapour through the lower pressure rectification column 56 is created by operation of the condenser-reboiler 38 partially to vaporise liquid collecting in the sump of the column 56. Mass exchange takes place between ascending vapour and descending liquid in the column 56 on the surfaces of liquid-vapour contact devices 80 which typically take the form of packing, for example, structured packing or random packing.

A stream of impure nitrogen vapour flows out of the top of the lower pressure rectification column 56 through an outlet 82 and passes through the heat exchanger 42 through its cold end to its relatively warmer end. The impure nitrogen stream passes from the relatively warmer end of the heat exchanger 42 into a conduit 84 which (with reference again to FIG. 1) conducts the nitrogen to the cold end 14 of the main heat exchanger 10. The impure nitrogen stream flows through the main heat exchanger 10 from its cold end 14 to its warm end 12 and may be taken as a product or vented to the atmosphere at approximately ambient temperature. A gaseous oxygen product is withdrawn from a lower region of the lower pressure rectification column 56 at a level below all the packing 80 therein and flows via a conduit 86 to the main heat exchanger 10 (see FIG. 1). The gaseous oxygen product stream is warmed to approximately ambient temperature by passage through the main heat exchanger 10 from its cold end 14 to its warm end 12. It may be used in any process which requires the low pressure oxygen stream. In addition, a pump 88 withdraws a liquid oxygen stream from the sump of the lower pressure rectification column 56 and passes it through a heat exchanger 90 in which it is sub-cooled. The sub-cooled liquid oxygen stream flows through a throttling valve 92 into a storage tank 94. For ease of illustration, the tank 94 is shown in both FIGS. 1 and 2. A stream of liquid oxygen is continuously withdrawn from the tank 94 by means of pump 96 (see FIG. 1) which raises the pressure of the liquid oxygen stream to a chosen high pressure. The resulting pressurised oxygen stream (which may be above its critical pressure) is warmed by passage through the heat exchanger 28 in a direction countercurrent to that of the liquid air stream. The resulting warmed pressurised oxygen stream flows through the main heat exchanger 10 from its cold end 14 to its warm end 12 and is thus effectively vaporised and raised in temperature to approximately ambient temperature. The high pressure oxygen stream may, for example, be employed in a gasification or partial oxidation process. Sub-cooling of the liquid oxygen stream in the heat exchanger 90 (see FIG. 2) may be effected by indirect heat exchange with a liquid stream comprising oxygen and nitrogen preferably taken from the stream flowing to the inlet 70 to the lower pressure rectification column 56. The liquid stream is partially vaporised by the heat exchange and the residual liquid and resulting vapour flow into the lower pressure rectification column 56 through inlets 96 and 98 respectively at the same level as the inlets 66 and 68. If desired, a liquid oxygen product may be taken intermittently or continuously from the storage tank 94.

A liquid nitrogen stream is continuously withdrawn by a pump 102 from the storage tank 45. The pump 102 raises the pressure of the nitrogen to a chosen high pressure. The resulting pressurised nitrogen stream is warmed by passage through the heat exchanger 42 from its cold end to its relatively warmer end. The resulting warmed nitrogen stream flows from the heat exchanger 42 into a conduit 104 which (see FIG. 1) conducts the nitrogen to the main heat exchanger 10. The nitrogen stream flows through the main heat exchanger 10 from its cold end 14 to its warm end 12 and is thus produced at approximately ambient temperature as an elevated pressure nitrogen product. In addition, a substantial part of the liquid nitrogen product is taken for sale as such on the merchant market.

An argon-enriched oxygen stream typically having an argon content in the range of from 6 to 12% by volume is withdrawn in vapour state from the lower pressure rectification column 56 through an outlet 106 at a level below that of the inlets 66, 68, 96 and 98. A part of this stream is introduced into the bottom of a part 110 of a two-part further rectification column 108. By the term "two-part rectification column", it is meant that the liquid-vapour contact devices 114 are housed in two separate columnar vessels, namely the vessels 110 and 112 referred to herein as part columns. The part column 112 handles the higher argon concentrations. The base of the part column 110 is located at such a level that flow of fluid between the lower pressure rectification column 56 and the part column 110 can take place without the aid of any pump. The top of the part column 110 preferably does not extend above the top of the lower pressure rectification column 56. Flow of vapour from the top of the part column 110 to the bottom of the part column 112 takes place via a conduit 116. Vapour at the head of the part column 112 is condensed in the condenser 64 by indirect heat exchange with the liquid stream taken from the vessel 52. A part of the resulting argon condensate flows back down the part column 112 as reflux. It is transferred from the bottom of the part column 112 to the top of the part column 110 by a pump 118. The bottom of the part column 112 is typically located at approximately the same level as the bottom of the higher pressure rectification column 18, or a level a little thereabove. The top of the condenser 64 is typically located at a level or elevation a little below that of the top of the lower pressure rectification column 56. Such an arrangement of the two part columns 110 and 112 keeps down the total height of the insulated housing, typically referred to as a "cold box" (not shown) in which the columns and heat exchangers are housed. The liquid introduced into the top of the part column 110 by the pump 118 flows downwardly therethrough and is returned from the bottom of the part column 110 to the lower pressure rectification column 56 via the conduit 120. Not all of the argon-containing vapour stream withdrawn from the lower pressure rectification column 56 through the outlet 106 flows to the rectification column 108. A part of it is employed to heat the liquid fed into the boiler 54. As a result, this part is condensed and the resulting condensate is returned to the conduit 120 and from there to the lower pressure rectification column 56.

Intimate liquid-vapour contact and hence mass exchange between the liquid phase and the vapour phase take place in the rectification column 108. As a result, the product obtained at the top of the part column 112 is argon. By arranging there to be a sufficient mount of packing in the column 108, typically in the order of 200 theoretical trays, an essentially oxygen-free product is obtained. This product may however typically contain up to 2000 parts per million of nitrogen.

Impure argon product is withdrawn from the argon condenser and is passed through a throttling valve 122 which typically reduces the pressure of the liquid stream from 1.4 bar to 1.05 bar and is introduced into a middle region of a fractionation column 124 in which nitrogen impurity is stripped from the argon. Since argon forms less than 1% by volume of the incoming air, the fractionation column 124 is relatively small in comparison with the other columns. It is provided at its bottom with the reboiler 48 and has a condenser 126 at its top. The condenser 126 is cooled by passage therethrough of a stream of liquid air which is taken from that flowing from the higher pressure rectification column 18 to the inlet 70 to the lower pressure rectification column 56. The resulting vapour stream is merged with the stream that flows from the condenser 64 to the inlet 68 to the lower pressure rectification column 56. The column 124 contains packing elements to enable contact to take place between rising vapour created by the reboiler 48 and descending liquid introduced from the condenser 126 and introduced via the conduit 122. A pure argon product is withdrawn from the bottom of the column 124 through a pipeline 130 and is sent to storage (not shown).

Referring again to FIG. 1, refrigeration for the plant is created by operation of two expansion turbines 132 and 134. The turbine 132 drives the booster-compressor 26 and the expansion turbine 134 drives the booster-compressor 24. The way in which the respective turbines 132 and 134 are coupled to the respective booster-compressors 26 and 24 is well known in the art and need not be described herein. The expansion turbine 132 receives a stream of air from the booster-compressor 22 which has been chilled to a temperature typically in the range of 0° to −20° C. by passage through part of the main heat exchanger 10. The chilled air stream is expanded with the performance of external work (namely the driving of the compressor 26) in the expansion turbine 132 and exits at a pressure a little above the operating pressure at the bottom of the higher pressure rectification column 18 and at a temperature typically in the range of 140 to 180K. The expanded stream is reintroduced to an intermediate region of the main heat exchanger 10 and is combined therein with the stream that flows directly from the purification unit 8 to the conduit 16 for vaporous air.

The flow to the expansion turbine 134 is created by withdrawing air from the high pressure air stream flowing through the main heat exchanger 10 from the booster-compressor 26 to the conduit 30. The withdrawal takes place at a region where the temperature is approximately the same as the temperature at which the stream from the other expansion turbine 132 is reintroduced into the main heat exchanger 10. The expansion turbine 134 expands this flow of air with the performance of external work (namely the driving of the compressor 24). The air exits the turbine 134 at essentially the pressure at the bottom of the higher pressure rectification column 18 and at approximately its saturation temperature. The air flows from the expansion turbine 134 into the conduit 16 in which it becomes mixed with the other flow of air therethrough.

If desired, the arrangement of the expansion turbines 132 and 134 and the passages through the main heat exchanger 10 that place the conduit 16 in communication with the conduit that extends from the outlet of the purification unit 8 to the warm end 12 of the main heat exchanger 10 may be as described in our co-pending application GB 9515907.5. Thus, a part of the flow of the expanded air from the turbine 132 may be recycled to the booster-compressor 22, and all the air leaving the purification unit 8 also flows to the booster-compressor 22; or all the air from the expansion turbine 132 and a part of the expanded air from the turbine 134 is recycled to the booster-compressor 22. Adjustment may be made to the machines so as to determine which flow regime operates.

The more air that is so recycled the greater the rate of production of liquid air and hence the greater the rate at which liquid products can be produced. So varying the amount of recycle to the booster-compressor 22 enables a long term change in demand pattern for liquid products relative to gaseous products to be met, but is not suitable for meeting changes in the demand pattern that take place over short periods of time (e.g. daily) since adjustment to machines takes time to perform.

Figure 2:
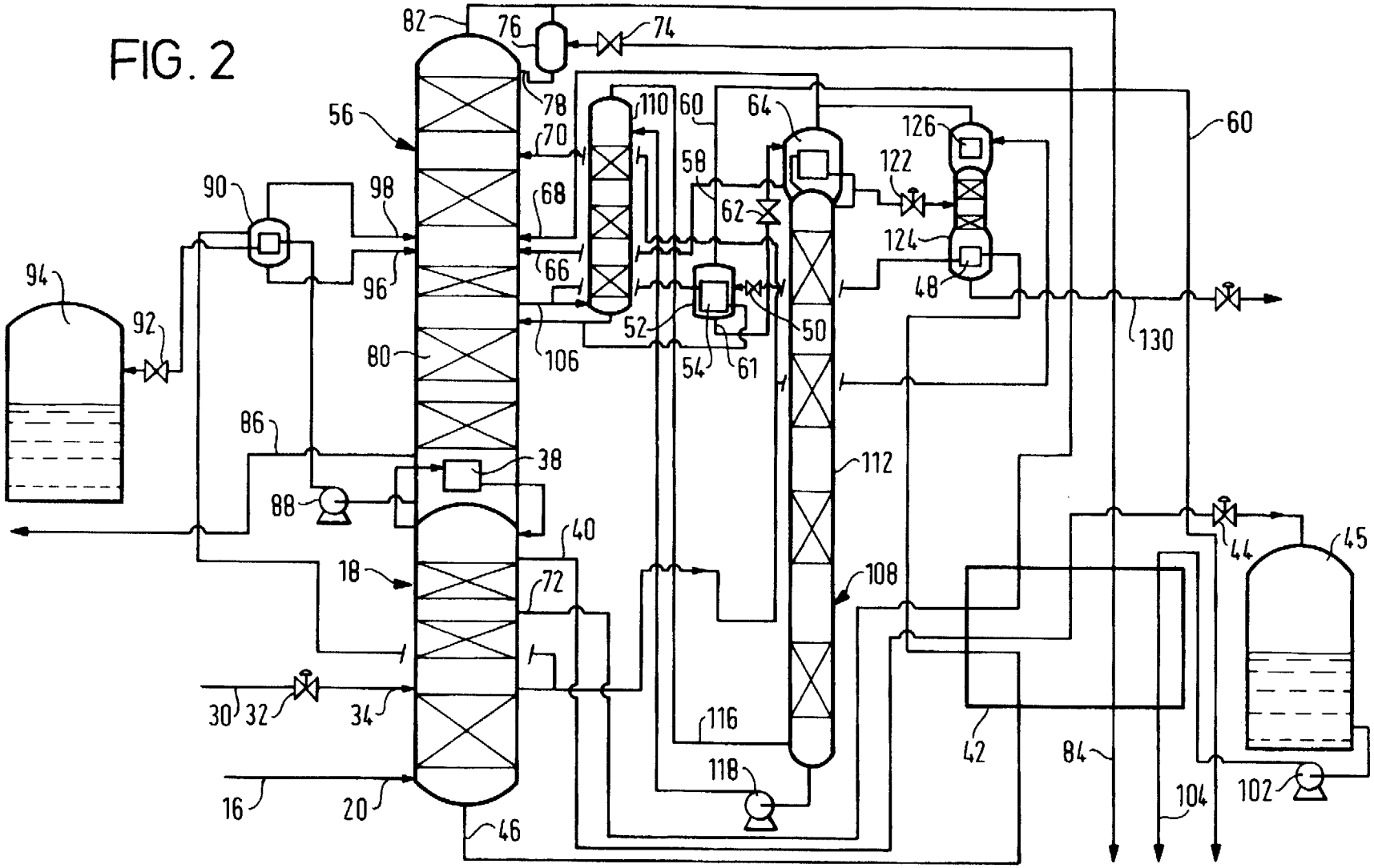
FIG. 2 is a schematic flow diagram of another part of the air separation plant.

In a typical example of the operation of the plant shown in FIGS. 1 and 2, the outlet pressures of the stage 4 of the main compressor 2, the stage 6 of the main compressor 2, the booster-compressor 22, the booster-compressor 24 and the booster-compressor 26 are respectively 2.4, 5.8 33.0, 45.0 and 58.0 bar. The pressure at the top of each of the columns 18, 56, 108 and 126 are respectively 5.4, 1.4, 1.3 and 1.03 bar. The elevated pressure gaseous nitrogen product leaves the main heat exchanger 10 at a pressure of 27 bar and the elevated pressure oxygen product leaves the heat exchanger 10 at a pressure of 27 bar. In this example, 40% by volume of the oxygen-enriched liquid withdrawn from the bottom of the higher pressure rectification column 18 through the outlet 46 is recycled to the downstream stage 6 of the main compressor 2. Liquid nitrogen product is taken at a rate of 60% of the total rate of production of oxygen product. In the absence of any recycle of oxygen-enriched liquid air, this ratio would typically be reduced to 25% if there is to be no loss of argon recovery (which is set at 85% in the typical example). It can thus be appreciated that the method and apparatus according to the invention make possible a substantial increase in the rate at which liquid nitrogen product can be taken without reduction in the argon recovery.

I claim:

1. A method of separating air comprising:

introducing a part of the air into an arrangement of rectification columns in a liquid state and taking a liquid nitrogen product therefrom;

compressing a flow of air and introducing a part of the compressed air flow in vapour state into a higher pressure rectification column of said arrangement and separating the air therein into a nitrogen fraction and an oxygen-enriched liquid fraction;

withdrawing a stream of the oxygen-enriched liquid fraction from the higher pressure rectification column;

passing a first part of the oxygen-enriched liquid stream along a first route that leads to a lower pressure rectification column, and separating an oxygen product in the lower pressure rectification column; and passing a second part of the oxygen-enriched liquid stream along a second route leading back to the compression of the air.

2. The method as claimed in claim 1, wherein the first and second routes divide from one another in a boiler in which the oxygen-enriched liquid is partially reboiled, resulting vapour follows the second route, and residual liquid follows the first route.

3. The method as claimed in claim 2, wherein the oxygen-enriched liquid is partially reboiled in indirect heat exchange with a vapour stream withdrawn from the lower pressure rectification column.

4. The method as claimed in claim 3, wherein a stream of argon-containing fluid is withdrawn from the lower pressure rectification column and has an argon product separated therefrom in a further rectification column and the said vapour stream withdrawn from the lower pressure rectification column has the same composition as the stream of argon-containing fluid.

5. The method as claimed in claim 2, wherein the boiler is heated by nitrogen vapour taken from the higher pressure rectification column.

6. The method as claimed in claim 2, wherein a stream of argon-containing fluid is withdrawn from the lower pressure rectification column and has an argon product separated from it in a further rectification column and the boiler acts as a condenser for the further rectification column.

7. The method as claimed in claim 6, wherein the residual oxygen-enriched liquid is partially boiled in the condenser, and the resulting vapour is introduced into the lower pressure rectification column.

8. The method as claimed in claim 7, wherein at least part of the flow of vaporous air into the higher pressure rectification column comprises air that has been further compressed and expanded with the performance of external work and some of the work expanded air is recycled to the further compression.

9. The method as claimed in claim 2, wherein a stream of argon-containing fluid is withdrawn from the lower pressure rectification column and has an argon product separated from it in a further rectification column and a stream of residual liquid flows from the boiler to a condenser associated with the further rectification column and provides cooling for the condenser.

10. The method as claimed in claim 1, wherein the air is compressed in a main air compressor comprising an upstream stage and a downstream stage, and the second route leads back to a location downstream of the first stage but upstream of the second stage.

11. An apparatus for separating air, comprising:

a higher pressure rectification column for separating air into a nitrogen fraction and an oxygen-enriched liquid fraction;

a lower pressure rectification column;

an air liquefier;

an inlet for liquid air into one or more of the rectification columns;

a nitrogen outlet from one of the rectification columns for liquid nitrogen product;

at least one compressor for compressing a flow of air;

an air inlet to the higher pressure rectification column for air in vapour state;

a product outlet from the lower pressure rectification column for an oxygen product; and an oxygen enriched liquid outlet from the higher pressure rectification column for a stream of the oxygen-enriched liquid fraction;

the oxygen enriched liquid outlet from the higher pressure rectification column communicating with a first route for the oxygen-enriched liquid that leads to the lower pressure rectification column;

the oxygen enriched liquid outlet communicating with a second route for the oxygen-enriched liquid that leads back to the said compressor.

12. The apparatus as claimed in claim 11, in which the arrangement of rectification columns includes a further rectification column, communicating with the lower pressure rectification column, for separating an argon product from an argon containing stream.

13. The apparatus as claimed in claim 12, in which the arrangement of rectification columns includes a fractionation column for purifying the argon product by removal of nitrogen therefrom which has a reboiler associated therewith and the reboiler associated with the fractionation column lies on the common upstream portion of the first and second routes.

14. The apparatus as claimed in claim 11, in which the first and second routes have an upstream portion in common.

15. The apparatus as claimed in claim 11, in which the first and second routes divide from one another in a boiler for partially reboiling the oxygen-enriched liquid, the boiler having an outlet to the second route for resulting vapour and another outlet to the first route for residual liquid.

16. The apparatus as claimed in claim 15, in which the boiler has heating passages that communicate at inlet and outlet ends with the lower pressure rectification column.

17. The apparatus as claimed in claim 15, in which the outlet for the residual liquid from the boiler communicates with cooling passages in a condenser associated with the further rectification column.

18. The apparatus as claimed in claim 11, in which the said compressor comprises a main compressor having an upstream and a downstream stage and the second route leads to a region downstream of the upstream stage but upstream of the downstream stage.

* * * * *